US008634583B2

(12) United States Patent
Bern

(10) Patent No.: US 8,634,583 B2
(45) Date of Patent: Jan. 21, 2014

(54) DEVICE AND METHOD FOR APPLYING A VIBRATION SIGNAL TO A HUMAN SKULL BONE

(75) Inventor: Bengt Bern, Smørum (DK)

(73) Assignee: Oticon Medical A/S, Smorum (DK)

( * ) Notice: Subject to any disclaimer, the term of this patent is extended or adjusted under 35 U.S.C. 154(b) by 187 days.

(21) Appl. No.: 13/115,612

(22) Filed: May 25, 2011

(65) Prior Publication Data

US 2011/0301404 A1 Dec. 8, 2011

Related U.S. Application Data

(60) Provisional application No. 61/351,955, filed on Jun. 7, 2010.

(30) Foreign Application Priority Data

Jun. 7, 2010 (EP) ..... 10165090

(51) Int. Cl.
*H04R 25/00* (2006.01)

(52) U.S. Cl.
USPC ..... 381/326; 381/151; 381/380; 381/60; 600/559

(58) Field of Classification Search
USPC ..... 381/151, 312, 313, 315–317, 320, 326, 381/380, 60; 600/25, 559; 607/55–57
See application file for complete search history.

(56) References Cited

U.S. PATENT DOCUMENTS 3,019,307 A 1/1962 Weiss
5,624,377 A 4/1997 Davis

FOREIGN PATENT DOCUMENTS

GB 2455202 A 6/2009
WO WO 92/13430 A1 8/1992
WO WO 2008/139404 A1 11/2008

OTHER PUBLICATIONS

"Contributions to a better understanding of fitting procedures for Baha", Hodgetts, William E., Ph.D., University of Alberta, 2008, NR45445.*
Carlsson et al., "Force threshold for hearing by direct bone conduction" The Journal of the Acoustical Society of America, American Institute of Physics for the Acoustical Society of America, New York, vol. 97, No. 2, Feb. 1995, pp. 1124-1129.
Hodgetts, "Contributions to a Better Understanding of Fitting Procedures for BAHA", University of Alberta, pp. 1-138 (2008).

* cited by examiner

*Primary Examiner* — Curtis Kuntz
*Assistant Examiner* — Joshua Kaufman
(74) *Attorney, Agent, or Firm* — Birch, Stewart, Kolasch & Birch, LLP

(57) ABSTRACT

Hearing losses caused by deficiencies in a person's outer or middle ear may be compensated for by converting received sounds to vibrations and transmitting the vibrations to the skull bone (2). Bone-conduction hearing devices (27) may transmit such vibrations transcutaneously or percutaneously. In both cases, a precise determination of the magnitude of the vibrations applied to the skull bone (2) is needed for determining the person's bone-conduction hearing thresholds as well as for calibrating the hearing devices (27). The present invention provides a device (1, 27, 37) and a method, which allow determination of the applied vibrational force with better precision than prior art devices and methods. This is achieved by placing an accelerometer (21) on the countermass (11) of the vibrator (1) that generates the vibration signal. The accelerometer (21) thus provides an acceleration signal representative of an acceleration of the countermass (11), from which acceleration signal the vibrational force may be determined precisely and reproducibly.

11 Claims, 5 Drawing Sheets

DEVICE AND METHOD FOR APPLYING A VIBRATION SIGNAL TO A HUMAN SKULL BONE

CROSS REFERENCE TO RELATED APPLICATIONS

This non provisional application claims the benefit Under 35 U.S.C. §119(e) to U.S. Provisional Application No. 61/351,955 filed on Jun. 7, 2010 and Under 35 U.S.C. §119(a) to Patent Application No. 10165090.1, filed on Jun. 7, 2010 in the European Patent Office. The entire contents of all of the above applications is hereby incorporated by reference into the Present application.

TECHNICAL FIELD

The present invention relates to a device and a method for applying a vibration signal to a human skull bone. More specifically, the present invention relates to such a device and such a method, which allow for determining the applied vibrational force.

The invention may e.g. be useful in applications such as determining bone-conduction hearing thresholds as well as calibrating and/or operating bone-conduction hearing devices.

BACKGROUND ART

It is well known in the art to compensate for hearing losses mainly caused by deficiencies in a person's outer or middle ear by converting received sounds to vibrations and transmitting the vibrations to the person's head. The bone structure of the skull leads the vibrations to the person's inner ear and thus enables the person to perceive the sounds. It is also known to use the same principle for compensating for single-sided deafness by placing the microphone receiving the sounds close to the person's deaf ear and letting the skull bone lead the vibrations to the opposite, intact inner ear.

A well-known type of bone-conduction hearing devices comprises a vibrator, which is pressed against the skin of the person's head by means of a spring or an elastic headband, and which transmits the vibrations to the skull bone through the skin and the subcutaneous tissue (transcutaneous transmission). Another well-known type of bone-conduction hearing devices comprises a vibrator detachably coupled to a fixture implanted (osseointegrated) in the skull bone. The vibrator transmits the vibrations to the skull bone through the fixture (percutaneous transmission).

For both types of bone-conduction devices, a precise determination of the magnitude of the vibrations applied to the skull bone is needed for determining a person's bone-conduction hearing thresholds as well as for calibrating the hearing devices. Therefore, various attempts have been made to develop devices and methods for determining the vibrational force and/or the vibrational acceleration.

The dissertation, "Contributions to a better understanding of fitting procedures for Baha", Hodgetts, William E., Ph.D., UNIVERSITY OF ALBERTA, 2008, NR45445, discloses a device for measuring a vibrational acceleration. The device comprises a vibrator ("BEST" transducer) with a stiff vibration element placed within a housing also acting as countermass. The vibration element comprises a coupling for the implanted fixture on one side of the housing and protrudes on the opposite side of the housing, where an accelerometer is attached to the vibration element. The accelerometer thus vibrates together with the vibration element, and its output signal represents the acceleration of the vibration element. Since, however, the mechanical impedance, or admittance, of the coupling is not well known and further may change, e.g. due to aging of the used materials and/or the person's tissue and bone structure, the correlation between the output of the accelerometer and the vibrational force applied to the skull lacks the desired precision.

It is an object of the present invention to provide a device and a method for applying a vibration signal to a human skull bone, which device and method allow determination of the applied vibrational force with better precision than prior art devices and methods.

DISCLOSURE OF INVENTION

This and other objects of the invention are achieved by the invention described in the accompanying independent claims and as described in the following. Further objects of the invention are achieved by the embodiments defined in the dependent claims and in the detailed description of the invention.

In the present context, a "hearing device" refers to a device suitable for improving or augmenting the hearing capability of an individual, such as e.g. a hearing aid. A "bone-conduction hearing device" refers to a hearing device adapted to receive acoustic signals from a person's surroundings, process the received signals, convert the processed signals into vibrations and transmit the vibrations to the bone structure of the person's head. The processing may include any combination of amplification, attenuation, frequency filtering, level compression, level expansion, noise reduction, feedback reduction and/or any other processing technique known in the art pertaining to hearing devices, such as e.g. hearing aids.

It is intended that the structural features of the systems and devices described herein, in the detailed description of 'mode(s) for carrying out the invention', in the 'features of the invention' and in the claims can be combined with the methods, when appropriately substituted by a corresponding process. Embodiments of the methods have the same advantages as the corresponding systems.

Further objects of the invention are achieved by the embodiments defined in the dependent claims and in the detailed description of the invention.

As used herein, the singular forms "a", "an", and "the" are intended to include the plural forms as well (i.e. to have the meaning "at least one"), unless expressly stated otherwise. It will be further understood that the terms "has", "includes", "comprises", "having", "including" and/or "comprising", when used in this specification, specify the presence of stated features, integers, steps, operations, elements and/or components, but do not preclude the presence or addition of one or more other features, integers, steps, operations, elements, components and/or groups thereof. It will be understood that when an element is referred to as being "connected" or "coupled" to another element, it can be directly connected or coupled to the other element, or intervening elements may be present, unless expressly stated otherwise. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF THE DRAWINGS

The invention will be explained in more detail below in connection with preferred embodiments and with reference to the drawings in which.

The figures are schematic and simplified for clarity, and they just show details, which are essential to the understanding of the invention, while other details are left out. Throughout, like reference numerals and/or names are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
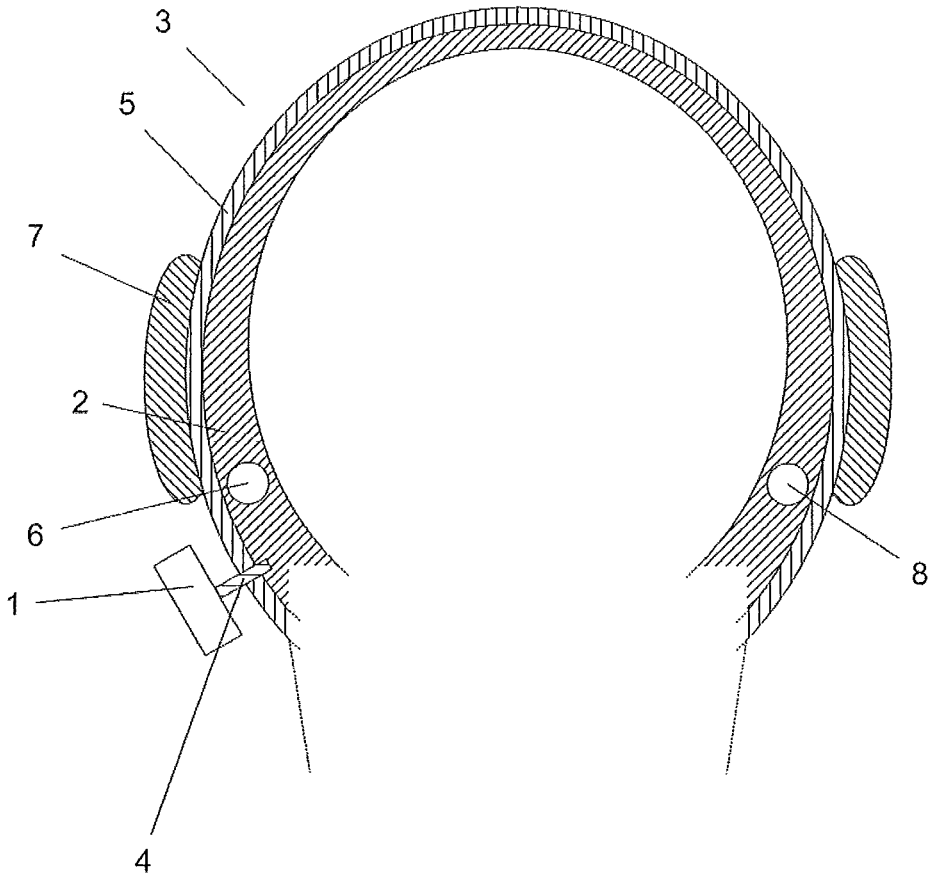
FIG. 1 shows a use of an embodiment of a vibrator according to the invention.

FIG. 1 shows a vibrator 1 connected to the skull bone 2 of a person's head 3 via a fixture 4 osseointegrated in the skull bone 2. The fixture 4 protrudes through the tissue 5 and the skin covering the skull 2. Vibrations generated in the vibrator 1 travel through the fixture 4 to the skull bone 2 and further on to the proximal inner ear 6. This enables the person to perceive the vibrations as sound, even in the case that the outer ear 7 or the middle ear (not shown) has a deficiency that causes acoustic signals to be attenuated, provided that the vibrations are strong enough. The vibrations also travel to the distal inner ear 8, which further enables the person to perceive the vibrations as sound in the case that the person is completely deaf on the proximal inner ear 6, again provided that the vibrations are strong enough.

Figure 2:
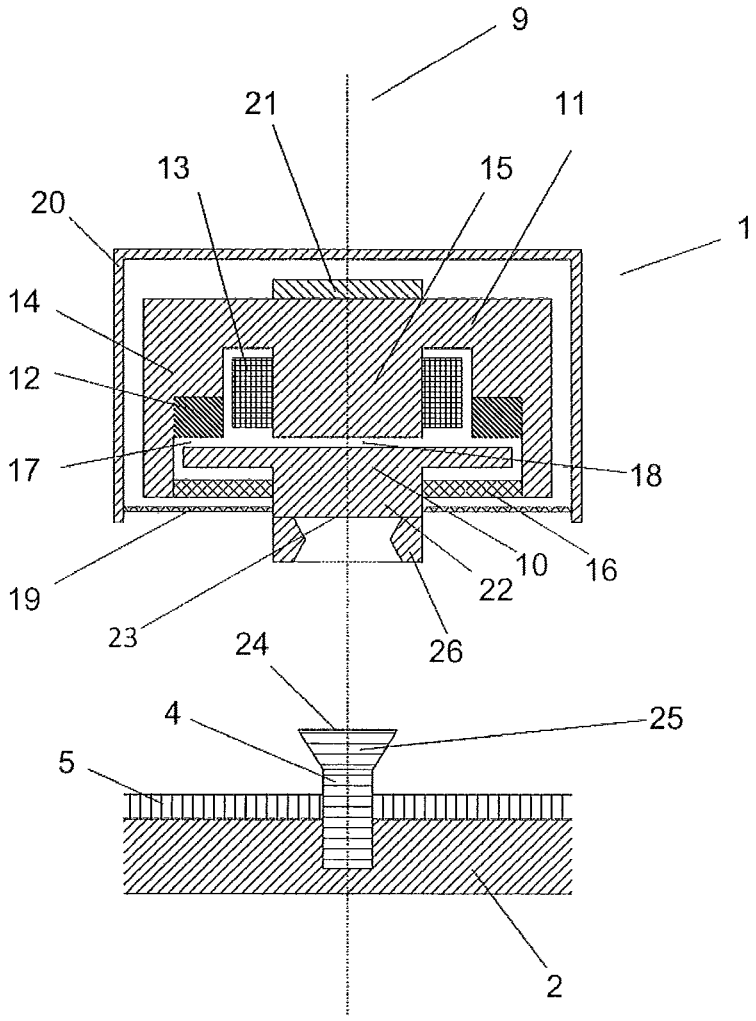
FIG. 2 shows a section through the vibrator of FIG. 1.

The vibrator 1 shown in the upper part of FIG. 2 is substantially rotationally symmetric with respect to the line 9 and comprises a vibration element 10, a countermass 11 as well as an electromagnetic motor comprising a permanent magnet 12 mechanically connected to a radially outer portion 14 of the countermass 11 and an electric coil 13 mechanically connected to a radially inner portion 15 of the countermass 11. A stiff, i.e. relatively non-compliant, annular spring 16 connects the vibration element 10 and the countermass 11 and retains these in a relative position in which they are separated by a radially outer air gap 17 and a radially inner air gap 18. A soft, i.e. relatively compliant, annular spring 19 connects the vibration element 10 and a housing 20, which forms an outer shield of the vibrator 1. An accelerometer 21 is mechanically connected to the countermass 11 and provides an electric acceleration signal representing the acceleration of the accelerometer 21, and thus also of the countermass 11, along the line 9. A portion 22 of the vibration element 10 protrudes through the centre of the annular springs 16, 19 and has a surface 23, which is adapted to abut a surface 24 on a corresponding protruding portion 25 of the fixture 4, which is shown in detail in the lower part of FIG. 2. An elastic, annular coupling element 26 is mechanically connected to the vibration element 10 and is adapted to form a detachable coupling to the protruding portion 25 of the fixture 4. When the coupling element 26 is coupled to the protruding portion 25 of the fixture 4, the coupling element 26 functions as a retaining element, which retains the vibrator 1 in its operating position, i.e. with the surface 23 of the vibration element 10 abutting the corresponding surface 24 of the fixture 4. The combined mass of the countermass 11, the permanent magnet 12, the electric coil 13 and the accelerometer 21 is dimensioned to be substantially larger than the combined mass of the vibration element 10, the housing 20, the coupling element 26 and the fixture 4.

Figure 3:
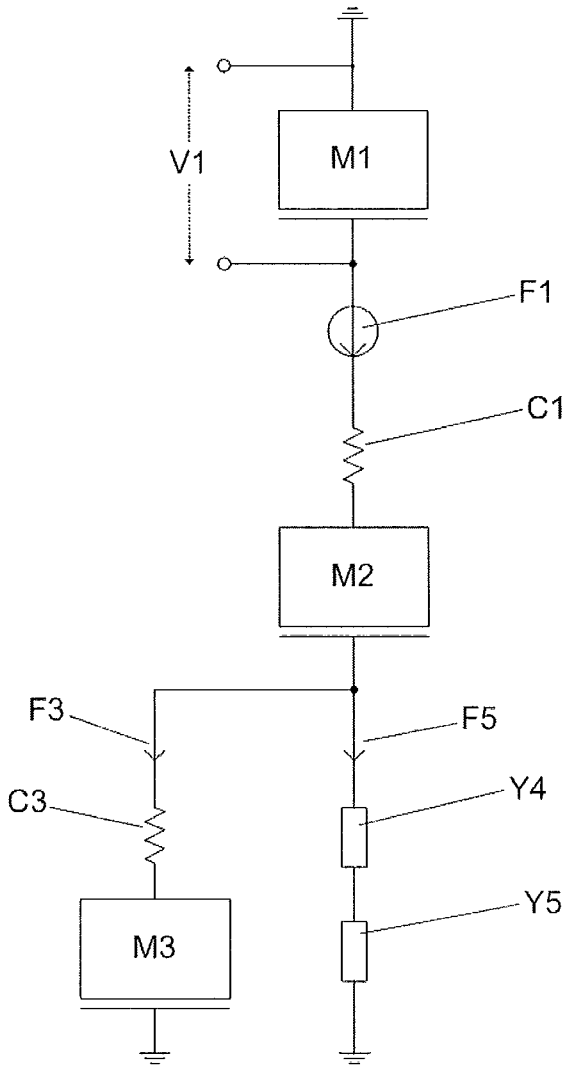
FIG. 3 shows an equivalent mechanic circuit for the vibrator of FIG. 2 in the position shown in FIG. 1.

FIG. 3 shows an admittance analogy of a mechanic circuit representing the vibrating parts of the vibrator 1 in its operating position. The mass M1 represents the combined mass of the countermass 11, the permanent magnet 12, the electric coil 13 and the accelerometer 21, which are all mechanically connected to each other and thus move together as a substantially rigid element. The force generator F1 represents the vibrational force generated by the motor 12, 13. The compliance C1 represents the compliance of the stiff annular spring 16 connecting the countermass 11 and the vibration element 10. The mass M2 represents the mass of the vibration element 10. The compliance C3 represents the compliance of the soft annular spring 19 connecting the housing 20 and the vibration element 10. The mass M3 represents the mass of the housing 20. The mechanical admittance Y4 represents the combined mechanical admittance of the coupling element 26 and the fixture 4 connecting the vibration element 10 and the skull bone 2. The mechanical admittance Y5 represents the mechanical admittance of the skull bone 2. The force F3 represents the vibrational force applied to the soft annular spring 19. The force F5 represents the vibrational force applied to the fixture 4. The velocity V1 represents the vibrational velocity of the rigid element comprising the countermass 11, the motor parts 12, 13 and the accelerometer 21. All forces F1, F3, F5 and the velocity V1 are directed along the line 9 shown in FIG. 2.

The functioning of the vibrator 1 is explained in the following with reference to FIGS. 1 to 3. It is assumed that the coupling element 26 retains the vibrator 1 in its operating position, i.e. with the surface 23 of the vibration element 10 abutting the corresponding surface 24 of the fixture 4, with a mechanical force strong enough to ensure the abutting of the surfaces 23, 24, even when the vibration element 10 vibrates.

The countermass 11, the inner air gap 18, the vibration element 10, the outer air gap 17 and the magnet 12 together form a closed magnetic circuit. An electric signal generator (not shown) provides an oscillating electric signal to the windings of the electric coil 13, which thus induces an oscillating magnetic flux in the inner portion 15 of the countermass 11 and thus in the entire magnetic circuit 11, 18, 10, 17, 12. The oscillating magnetic flux causes an oscillating force F1 across the air gaps 17, 18, which causes the vibration element 10 and the countermass 11 to vibrate relative to each other, in a direction along the line 9 and against the retaining force of the stiff annular spring 16. The vibrational force F1 progresses through the vibration element 10, and a portion F3 of the vibrational force F1 acts on the soft annular spring 19, while another portion F5 acts on the coupling element 26 and the fixture 4. The vibrational force F5 acting on the coupling element 26 and the fixture 4 progresses to the skull bone 2 and thus applies a vibration signal corresponding to the electric signal to the skull bone 2. The fixture 4 thereby acts as an intervening element, which transfers the vibration signal from the vibrator 1 to the skull bone 2.

The flow of, and the relations between, the vibrational forces F1, F3, F5 may be deducted from the mechanic circuit shown in FIG. 3, from which it can be seen that the vibrational force F1, which acts on the mass M1 equals the sum of the vibrational forces F3 and F5. Furthermore, it can be seen that the vibrational force F5 acts in full on the skull bone Y5, 2. The vibrational force F5 acting on the skull bone Y5, 2 may thus be determined by determining the vibrational force F1 acting on the mass M1 and subtracting therefrom the vibrational force F3 acting on the housing M3, 20. The vibrational force F1 acting on the mass M1 may be determined precisely by multiplying the mass M1 by the vibrational acceleration of the mass M1. The vibrational acceleration of the mass M1 may be derived from the electric acceleration signal from the accelerometer 21, and the mass M1 may be determined by weighing the components 11, 12, 13, 21 represented by the mass M1.

The mass M3 of the housing 20 and the compliance C3 of the soft annular spring 19 are dimensioned to ensure that the vibrational force F3 acting on the soft annular spring 19 is orders of magnitude smaller than the vibrational force F5 acting on the skull bone 2. The vibrational force F3 acting on the housing M3, 20 may thus be ignored in the determination of the vibrational force F5 acting on the skull bone Y5, 2, which thus substantially equals the vibrational force F1 acting on the mass M1. In order to ensure that the vibrational force F3 acting on the soft annular spring 19 is relatively small, the housing M3, 20 and the soft annular spring C3, 19 are dimensioned so that their frequency of resonance is well below the audio frequency range and further so that the mechanical admittance of the soft annular spring C3, 19 is orders of magnitude larger than the combined mechanical admittance Y4+Y5 of the coupling element 26, the fixture 4 and the skull bone 2. Even though the mechanical admittance Y4+Y5 is not very well known, which is part of the reason for the relatively low precision of prior art methods of determining the magnitude of the vibration signal, a statistically safe upper limit for the mechanical admittance Y4+Y5 may be established from measurements on a representative sample of human individuals.

Alternatively, a further accelerometer (not shown) may be connected to the housing 20, and the vibrational force F3 acting on the soft annular spring 19 may be determined similarly to determining the vibrational force F1 acting on the mass M1 and subtracted therefrom as explained further above. In this case, the vibrational force F5 acting on the skull bone 2 may be determined precisely and substantially without any knowledge of the mechanical admittance Y4+Y5.

Alternatively to having the soft annular spring 19 connect the housing 20 to the vibration element 10, a similar spring (not shown) may connect the housing 20 to the countermass 11, in which case the same computations as mentioned above may be used for determining the vibrational force F5 acting on the skull bone 2. Since, however, the countermass 11 typically vibrates at a higher velocity V1 than the vibration element 10, due to the relative high mass of the skull bone 2, such a connection may cause the housing 20 to also vibrate at a higher velocity, which may lower the precision of the method for determining the vibrational force F5 acting on the skull bone 2.

An advantage of the vibrator 1 is that it enables a precise and reproducible determination of a magnitude-related parameter of the vibration signal, i.e. the vibrational force F5 acting on the skull bone 2. Such a reproducibly determined parameter may be used to determine a reference for e.g. adjusting or calibrating the output of the vibrator 1 itself and/or for measuring reproducible bone-conduction hearing thresholds. The vibrator 1 may thus advantageously be incorporated into a bone-conduction hearing device 27 (see FIG. 4) or in an audiometer 37 (see FIG. 5).

Figure 4:
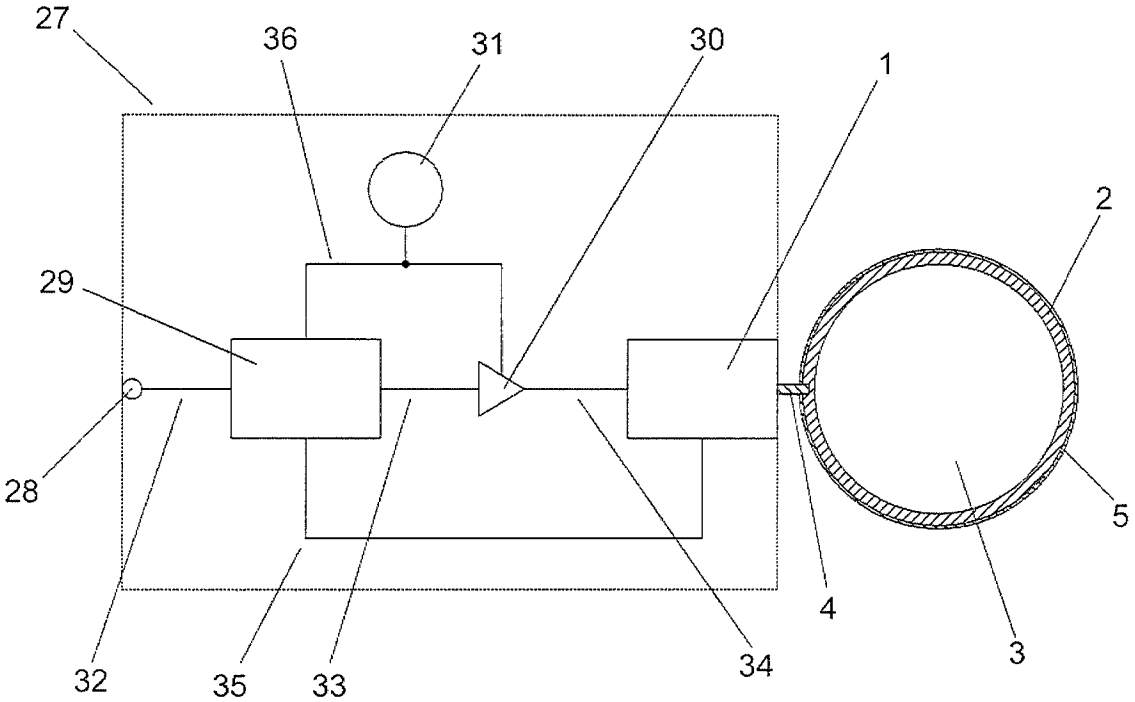
FIG. 4 shows a block diagram of an embodiment of a bone-conduction hearing device according to the invention.

The bone-conduction hearing device 27 shown in FIG. 4 comprises a microphone 28, a signal processor 29, a power amplifier 30, a vibrator 1 corresponding to the vibrator 1 described in detail above and shown in FIGS. 1 to 3 as well as a battery 31. The microphone 28 is arranged to receive acoustic signals from a person's surroundings and adapted to provide a corresponding input signal to the signal processor 29 via a first connection 32. The signal processor 29 is adapted to process the input signal and provide a corresponding processed signal to the power amplifier 30 via a second connection 33. The power amplifier 30 is adapted to amplify the processed signal and provide a corresponding amplified signal to the electric coil 13 of the vibrator 1 via a third connection 34. The vibrator 1 is connected to the skull bone 2 of the person's head 3 via a fixture 4 osseointegrated into the skull bone 2, substantially as described above in connection with FIG. 2. In this operating position of the vibrator 1, the vibrator 1 is adapted to convert the amplified signal into a vibration signal and transmit the vibration signal to the skull bone 2 via the fixture 4, i.e. percutaneously. The vibrator 1 is further adapted to provide an acceleration signal representing the acceleration of the countermass 11 to the signal processor 29 via a fourth connection 35. The battery 31 is connected to provide electric power to the signal processor 29 and the power amplifier 30 via a power distribution net 36. The microphone 28, the signal processor 29, the power amplifier 30, and the battery 31 are mechanically connected to a printed circuit board (not shown), which is shielded by and mechanically connected to the housing 20 of the vibrator 1.

The bone-conduction hearing device 27 receives the acoustic signals and determines a desired magnitude of the vibration signal in dependence on the magnitude and frequency of the acoustic signals. Various settings, which may be programmed during fitting of the bone-conduction hearing device 27 and/or controlled by the person wearing the bone-conduction hearing device 27, are also taken into account. The signal processor 29 processes the input signal to provide a vibration signal with the desired magnitude. The signal processor 29 monitors the acceleration signal in order to determine whether the vibrator 1 actually causes a vibration signal with the desired magnitude and in case of deviations adjusts the processed signal and/or the amplified signal accordingly. Thus, the bone-conduction hearing device 27 is able to provide a vibration signal with a calibrated gain between the acoustic signals and the vibration signal. The settings of the bone-conduction hearing device 27 may include a prescription of vibrational force in dependence on the magnitude and frequency of the acoustic signals. In this case, the signal processor 29 may be adapted to determine the magnitude and frequency of the acoustic signals, compute the currently applied vibrational force from the acceleration signal and adjust the processed signal and/or the amplified signal to obtain an applied vibrational force corresponding to the prescribed vibrational force.

Figure 5:
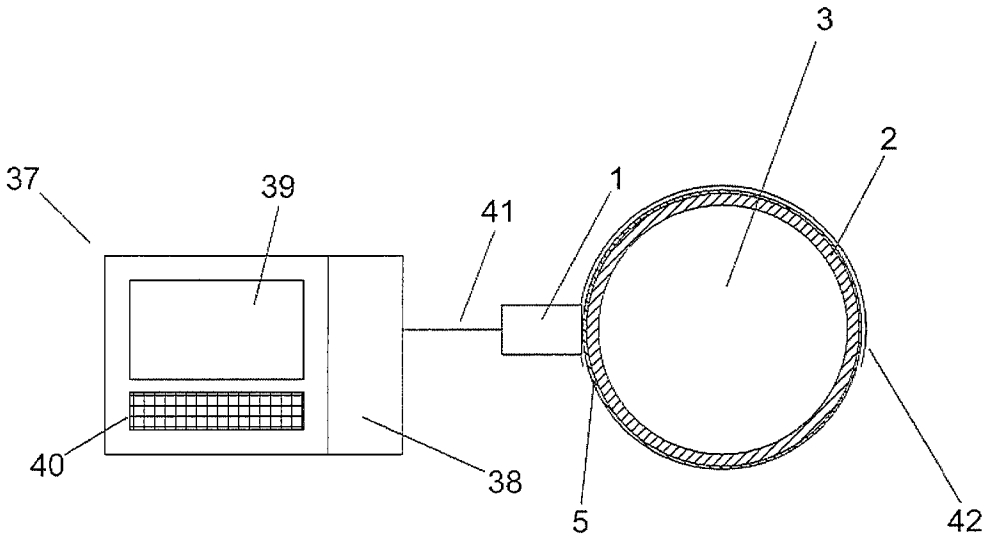
FIG. 5 shows a block diagram of an embodiment of an audiometer according to the invention.

The audiometer 37 shown in FIG. 5 comprises a computer 38 with a signal generator (not shown), a display 39, a keyboard 40, a vibrator 1 substantially corresponding to the vibrator 1 described in detail above and shown in FIGS. 1 to 3, a cable 41 connecting the computer 38 and the vibrator 1, as well as an elastic headband 42, which replaces the coupling element 26. The headband 42 is mechanically connected to the vibration element 10 of the vibrator 1 and presses this against the skin and tissue 5 covering the skull bone 2 of the person's head by applying a clamping force around the head, thus functioning as a retaining element. In this operating position of the vibrator 1, the surface 23 of the vibration element 10 abuts a corresponding portion of the skin, and the skin and tissue 5 thus functions as an intervening element, which transfers the vibration signal from the vibration element 10 to the skull bone 2, i.e. transcutaneously. The computer 38 is programmed to aid e.g. an audiologist in determining bone-conduction hearing thresholds for a person by providing oscillating electrical signals of varying frequency and magnitude via the cable 41 to the electric coil 13 of the vibrator 1 and allowing recording of the person's responses to the resulting vibration signals. An acceleration signal representing the acceleration of the countermass 11 is provided by the vibrator 1 and led to the computer 38 through the cable 41. The computer 38 monitors the acceleration signal and adjusts the magnitude of the oscillating electrical signals to obtain predetermined, i.e. calibrated, vibrational force magnitudes. Upon determining a bone-conduction hearing threshold, the computer 38 computes the corresponding vibrational force and stores the computed vibrational force value as an absolute bone-conduction threshold. Such absolute bone-conduction thresholds may subsequently be used by a bone-conduction hearing device 27 to adjust the magnitude of its vibration signal as described further above in connection with FIG. 4.

As an alternative to the vibrator 1, the audiometer 37 may comprise a bone-conduction hearing device 27 substantially corresponding to the one described above in connection with FIG. 4, and the computer 38 may command the bone-conduction hearing device 27 to generate vibration signals at specific frequencies and magnitudes via the cable 41. In this case, the bone-conduction hearing device 27 controls the precision of the magnitude of the vibration signal as described further above. The communication between the computer 38 and the bone-conduction hearing device 27 may alternatively be wireless; this requires that the computer 38 and the bone-conduction hearing device 27 be equipped with corresponding radio or optic transceivers.

As describe above, the audiometer 37 comprises a vibrator 1 adapted to transcutaneous transmission of the vibration signal to the skull bone 2, since this type of vibrator 1 may easily be used on persons not having an osseointegrated fixture 4. However, the audiometer 37 may instead—or additionally—comprise a vibrator 1 adapted to percutaneous transmission on persons having an osseointegrated fixture 4, since this allows a more reproducible and precise positioning of the vibrator 1 relative to the skull bone 2.

As described further above, the bone-conduction hearing device 27 comprises a vibrator 1 adapted to percutaneous transmission of the vibration signal to the skull bone 2, since this type of vibrator 1 allows for a more reproducible positioning of the vibrator 1 relative to the skull bone 2. However, the bone-conduction hearing device 27 may instead comprise a vibrator 1 adapted to transcutaneous transmission, e.g. for persons who for some reason are not eligible to or do not want to have an osseointegrated fixture 4. This could e.g. apply to an initial test period during which data for determining the need for implanting a fixture 4 are collected.

Some preferred embodiments have been shown in the foregoing, but it should be stressed that the invention is not limited to these, but may be embodied in other ways within the subject-matter defined in the following claims. For example, the features of the described embodiments may be combined arbitrarily.

Further modifications obvious to the skilled person may be made to the disclosed methods and devices without deviating from the spirit and scope of the invention. Within this description, any such modifications are mentioned in a non-limiting way.

Any reference numerals in the claims are intended to be non-limiting for their scope.

FEATURES OF THE INVENTION

The below described features of the invention may be combined arbitrarily in order to adapt the method and/or the system according to the invention to specific requirements.

A device 1, 27, 37 for applying a vibration signal to a human skull bone 2 may comprise a vibration element 10, a motor 12, 13, a countermass 11, a retaining element 26, 42 and an accelerometer 21. The vibration element 10 may be adapted to transmit vibrations to the skull bone 2 via an intervening element 4, 5. The vibration element 10 may have a surface 23 adapted to abut the intervening element 4, 5 in an operating position of the device 1. The motor 12, 13 may be adapted to cause the vibration element 10 and the countermass 11 to vibrate relative to each other. The retaining element 26, 42 may be adapted to retain the device 1 in the operating position. The accelerometer 21 may be mechanically connected to the countermass 11 and be adapted to provide an acceleration signal representative of an acceleration of the countermass 11. This enables a precise and reproducible determination of a magnitude of the vibration signal.

The intervening element 4, 5 may comprise a fixture 4 osseointegrated in the skull bone 2. This enables a precise and reproducible positioning of the vibration element 10 relative to the skull bone 2.

The retaining element 26, 42 may comprise a detachable coupling 26 adapted to retain the vibration element 10 in abutment with the fixture 4. This enables quick and easy positioning of the device 1 in its operating position.

The intervening element 4, 5 may comprise a portion of skin and tissue 5 covering the skull bone 2. This allows for transmitting the vibration signal to persons 3 not having an implanted fixture 4.

The retaining element 26, 42 may comprise a spring and/or an elastic headband 42 adapted to retain the vibration element 10 in abutment with the skin. This enables quick and easy positioning of the device 1 in its operating position.

A bone-conduction hearing device 27 may comprise a device 1 for applying a vibration signal to a human skull bone 2 as described above. This enables the bone-conduction hearing device 27 to generate a vibration signal with a predetermined or calibrated magnitude.

An audiometer 37 may comprise a device 1 for applying a vibration signal to a human skull bone 2 as described above. This enables the audiometer to generate a vibration signal with a predetermined or calibrated magnitude.

An audiometer 37 may comprise a bone-conduction hearing device 27 as described above. This enables the audiometer to use an already fitted bone-conduction hearing device 27 for generating a vibration signal with a predetermined or calibrated magnitude.

A method for applying a vibration signal to a human skull bone 2 via an intervening element 4, 5 may comprise: in a vibrator 1, vibrating a vibration element 10 and a countermass 11 relative to each other; retaining the vibrator 1 in an operating position, wherein the vibration element 10 abuts the intervening element 4, 5; transmitting vibrations from the vibration element 10 to the intervening element 4, 5; and providing an acceleration signal representative of an acceleration of the countermass 11. This enables a precise and reproducible determination of a magnitude of the vibration signal.

The method may further comprise determining a vibrational force in dependence on the acceleration signal. This enables determining an objective magnitude-related parameter of the vibration signal.

The method may further comprise adjusting a magnitude of the vibration signal in dependence on the acceleration signal. This enables generating a vibration signal with a predetermined or calibrated magnitude.

The method may further comprise determining a hearing threshold in dependence on the acceleration signal. This enables determining a precise and reproducible bone-conduction hearing threshold.

An advantage of the invention is that bone-conduction hearing thresholds obtained using a vibrator 1 with transcutaneous transmission of the vibration signals are substantially equal to the corresponding bone-conduction hearing thresholds obtained using a vibrator 1 with percutaneous transmission. This enables the audiologist to accurately assess the benefits a hearing-impaired person may obtain by being fitted with a bone-conduction hearing device 27 with percutaneous transmission—even before a fixture 4 is implanted.

The invention claimed is:

1. A device for applying a vibration signal to a human skull bone, the device comprising:

a vibration element;

a motor;

a countermass;

a retaining element; and an accelerometer directly mounted on the countermass to measure an acceleration of the countermass and to provide an electrical signal representative of the acceleration of the countermass, wherein the vibration element is configured to transmit vibrations to the skull bone via an intervening element, the vibration element has a surface configured to abut the intervening element in an operating position of the device, the motor is configured to cause the vibration element and the countermass to vibrate relative to each other, and the retaining element is configured to retain the device in the operating position.

2. A device according to claim 1, wherein the intervening element comprises a fixture osseointegrated in the skull bone.

3. A device according to claim 2, wherein the retaining element comprises a detachable coupling adapted to retain the vibration element in abutment with the fixture.

4. A device according to claim 1, wherein the intervening element comprises a portion of skin and tissue covering the skull bone.

5. A device according to claim 4, wherein the retaining element comprises a spring and/or an elastic headband adapted to retain the vibration element in abutment with the skin.

6. A bone-conduction hearing device comprising a device according to any of the preceding claims.

7. An audiometer comprising a device according to claim 1.

8. A method for applying a vibration signal to a human skull bone via an intervening element, the method comprising:

vibrating a vibration element and a countermass relative to each other in a vibrator;

retaining the vibrator in an operating position, wherein the vibration element abuts the intervening element;

transmitting vibrations from the vibration element to the intervening element; and providing an electrical signal representative of an acceleration of the countermass by an accelerometer directly mounted on the countermass to measure the acceleration of the countermass and to provide the electrical signal representative of the acceleration of the countermass.

9. A method according to claim 8, and further comprising:

determining a vibrational force in dependence on the electrical signal representative of the acceleration of the countermass.

10. A method according to claim 8 or 9, further comprising:

adjusting a magnitude of the vibration signal in dependence on the electrical signal representative of the acceleration of the countermass.

11. A method according to claim 8, further comprising:

determining a hearing threshold in dependence on the electrical signal representative of the acceleration of the countermass.

* * * * *